US010554001B1

(12) United States Patent
Criswell et al.

(10) Patent No.: US 10,554,001 B1
(45) Date of Patent: Feb. 4, 2020

(54) PLUG AND MULTI-MODE CHARGING AND AUDIO CABLE

(71) Applicant: Plantronics, Inc., Santa Cruz, CA (US)

(72) Inventors: Thomas G Criswell, Santa Cruz, CA (US); Haidong Wang, Suzhou (CN); ShouBo Feng, Suzhou (CN)

(73) Assignee: Plantronics, Inc., Santa Cruz, CA (US)

( * ) Notice: Subject to any disclaimer, the term of this patent is extended or adjusted under 35 U.S.C. 154(b) by 0 days.

(21) Appl. No.: 16/112,726

(22) Filed: Aug. 26, 2018

(51) Int. Cl.

| | |
|---|---|
| ***H01R 24/58*** | (2011.01) |
| ***H01R 31/06*** | (2006.01) |
| ***H01R 13/04*** | (2006.01) |
| ***H04R 3/00*** | (2006.01) |
| ***H01R 13/10*** | (2006.01) |
| *H01R 107/00* | (2006.01) |

(52) U.S. Cl.
CPC ..... *H01R 31/06* (2013.01); *H01R 13/04* (2013.01); *H01R 13/10* (2013.01); *H01R 24/58* (2013.01); *H04R 3/00* (2013.01); *H01R 2107/00* (2013.01); *H04R 2420/09* (2013.01)

(58) Field of Classification Search
CPC ..... H01R 24/58; H01R 2103/00; H01R 2107/00; H01R 2105/00
See application file for complete search history.

(56) References Cited

U.S. PATENT DOCUMENTS

| | | | | |
|---|---|---|---|---|
| 6,439,932 | B1 * | 8/2002 | Ripolone | E21B 17/028 439/668 |
| 6,558,201 | B1 * | 5/2003 | Begley | H01R 31/06 439/638 |
| 7,212,420 | B2 * | 5/2007 | Liao | H01R 13/6675 363/146 |
| 8,556,659 | B1 * | 10/2013 | Rothkopf | H01R 13/64 439/620.21 |
| 9,774,152 | B2 * | 9/2017 | Los | H01R 24/58 |

* cited by examiner

*Primary Examiner* — Xuong M Chung Trans
(74) *Attorney, Agent, or Firm* — Chuang Intellectual Property Law

(57) ABSTRACT

A male plug for coupling with a female jack is arranged to prevent short circuiting during the insertion and removal process. The female jack includes first, second, third, and fourth contact terminals. The first and second contact terminals are separated by a first-to-second jack terminal separation distance, and the second and third contact terminals are separated by a second-to-third jack terminal separation distance. The male plug includes a first ring contact segment arranged to contact the third contact terminal of the female jack. The first ring contact segment has a length less than the first-to-second jack terminal separation distance and the second-to-third jack terminal separation distance. The male plug includes a second ring contact segment arranged to contact the second contact terminal of the female jack. The second ring contact segment has a length less than the first-to-second jack terminal separation distance and the second-to-third jack terminal separation distance.

16 Claims, 7 Drawing Sheets

300

| Contact Pin of Plug | USB Signal Name | 3.5mm Audio |
|---|---|---|
| Tip 2 | D- | L |
| Ring Contact 4 | D+ | R |
| Ring Contact 6 | GND | GND |
| Sleeve Contact 8 | VBUS | MIC |

PLUG AND MULTI-MODE CHARGING AND AUDIO CABLE

BACKGROUND OF THE INVENTION

Mobile electronic devices typically employ a rechargeable battery to allow for wireless operation. Users typically desire that the mobile device be lightweight and have a small physical form factor. For example, wireless headsets typically have a small form factor which necessitates the use of a small rechargeable battery. The wireless headset frequently becomes inoperable when the rechargeable battery can no longer provide sufficient power, resulting in a poor user experience. As a result, improved apparatuses and methods for recharging and using mobile electronic devices are needed.

BRIEF DESCRIPTION OF THE DRAWINGS

The present invention will be readily understood by the following detailed description in conjunction with the accompanying drawings, wherein like reference numerals designate like structural elements.

DESCRIPTION OF SPECIFIC EMBODIMENTS

Methods and apparatuses for plugs and multi-mode interconnect cables are disclosed. The following description is presented to enable any person skilled in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus, the present invention is to be accorded the widest scope encompassing numerous alternatives, modifications and equivalents consistent with the principles and features disclosed herein.

Block diagrams of example systems are illustrated and described for purposes of explanation. The functionality that is described as being performed by a single system component may be performed by multiple components. Similarly, a single component may be configured to perform functionality that is described as being performed by multiple components. For purpose of clarity, details relating to technical material that is known in the technical fields related to the invention have not been described in detail so as not to unnecessarily obscure the present invention. It is to be understood that various example of the invention, although different, are not necessarily mutually exclusive. Thus, a particular feature, characteristic, or structure described in one example embodiment may be included within other embodiments unless otherwise noted.

The inventors have recognized that a multi-mode connector system utilizing both 3.5 mm connectors and USB connectors would be advantageous to mobile device users. Furthermore, the inventors have recognized short circuit problems with the use of prior art conventional 3.5 mm connectors in charging applications.

Figure 8:
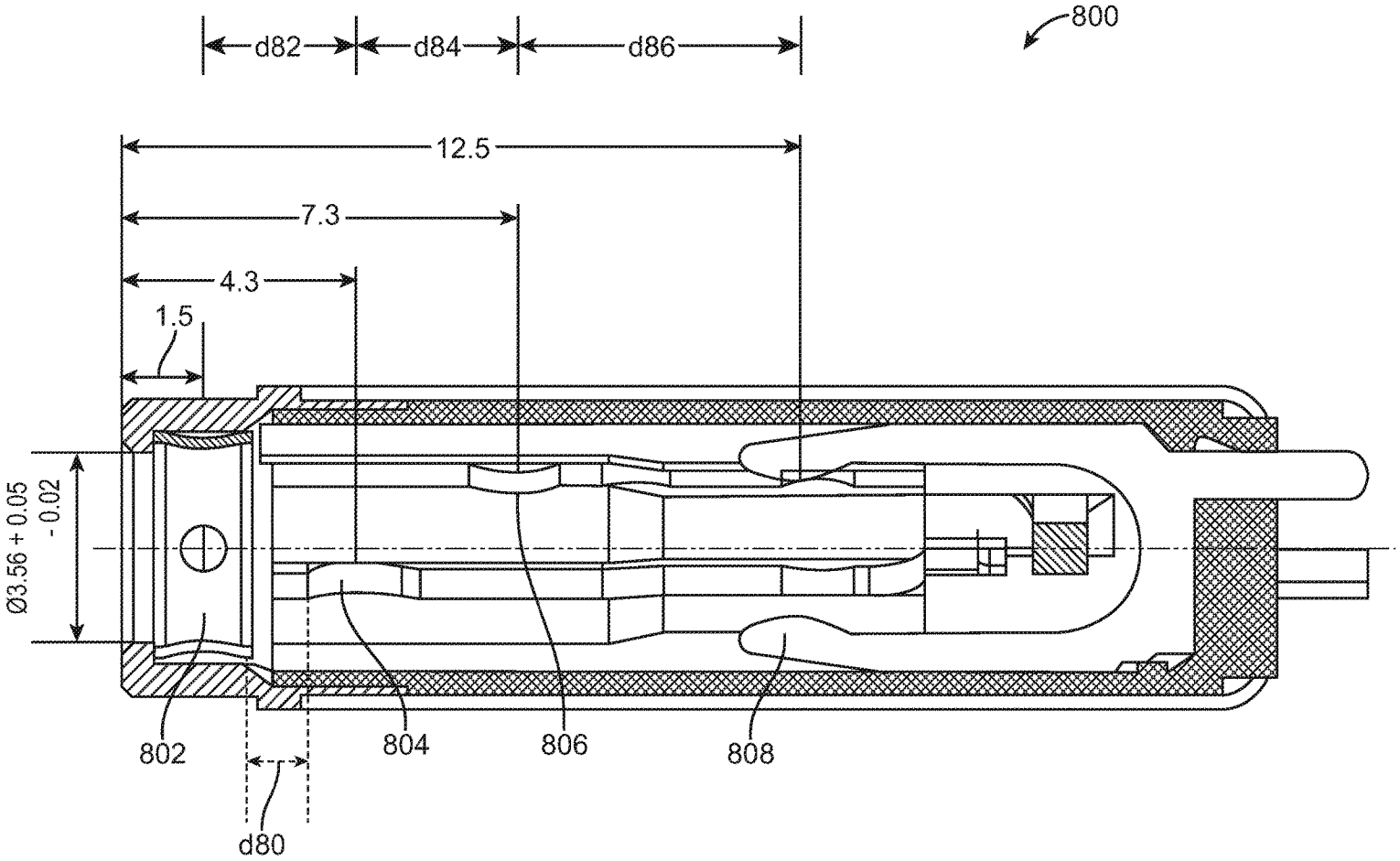
FIG. 8 (PRIOR ART)
FIG. 8 illustrates a prior art female jack for receiving the 3.5 mm male plug shown in FIG. 7.
Figure 9:
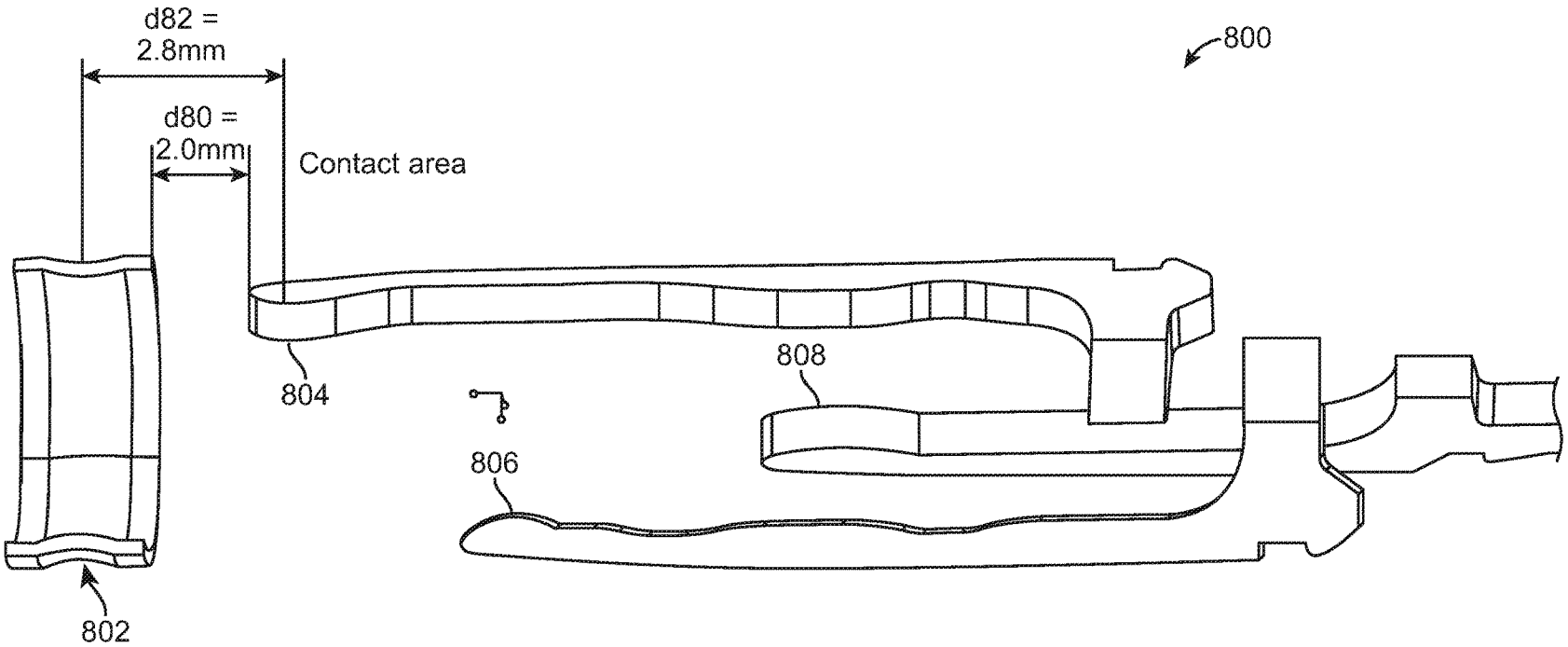
FIG. 9 (PRIOR ART)
FIG. 9 highlights the distinction between the first-to-second jack terminal separation distance and the distance between the center of the width of the first contact terminal and the second contact terminal.

FIG. 8 illustrates a female jack 800 in the prior art for receiving a 3.5 mm male plug. The female jack 800 includes a first contact terminal 802, a second contact terminal 804, a third contact terminal 806, and a fourth contact terminal 808. The first contact terminal 802 and the second contact terminal 804 are separated by a first-to-second jack terminal separation distance d80. First-to-second jack terminal separation distance d80 is measured as the gap between closest ends of the first contact terminal 802 and the second contact terminal 804, as illustrated in FIG. 8 and FIG. 9. This is due first contact terminal 802 having a width extending from its center point toward the second contact terminal 804. A distance d82 measures the distance between the center of the width of first contact terminal 802 and second contact terminal 804 primary contact area. FIG. 9 illustrates the first contact terminal 802, a second contact terminal 804, a third contact terminal 806, and a fourth contact terminal 808 in isolation to highlight the distinction between distance first-to-second jack terminal separation distance d80 and the distance d82. First-to-second jack terminal separation distance d80 is approximately 2.0 mm and the distance d82 is approximately 2.8 mm.

Referring again to FIG. 8, the second contact terminal 804 and the third contact terminal 806 are separated by a second-to-third jack terminal separation distance d84. The third contact terminal 806 and the fourth contact terminal 808 are separated by a third-to-fourth jack terminal separation distance d86. Second-to-third jack terminal separation distance d84 and third-to-fourth jack terminal separation distance d86 are measured from the primary contact areas arranged to contact the corresponding male plug contacts. Second-to-third jack terminal separation distance d84 is approximately 3.0 mm and third-to-fourth jack terminal separation distance d86 is approximately 5.2 mm. As also shown in FIG. 8, measured from the open end of female jack 800, first contact terminal 802 has a distance of 1.5 mm, second contact terminal 804 has a distance of 4.3 mm, third contact terminal 806 has a distance of 7.3 mm, and fourth contact terminal 808 has a distance of 12.5 mm.

Figure 7:
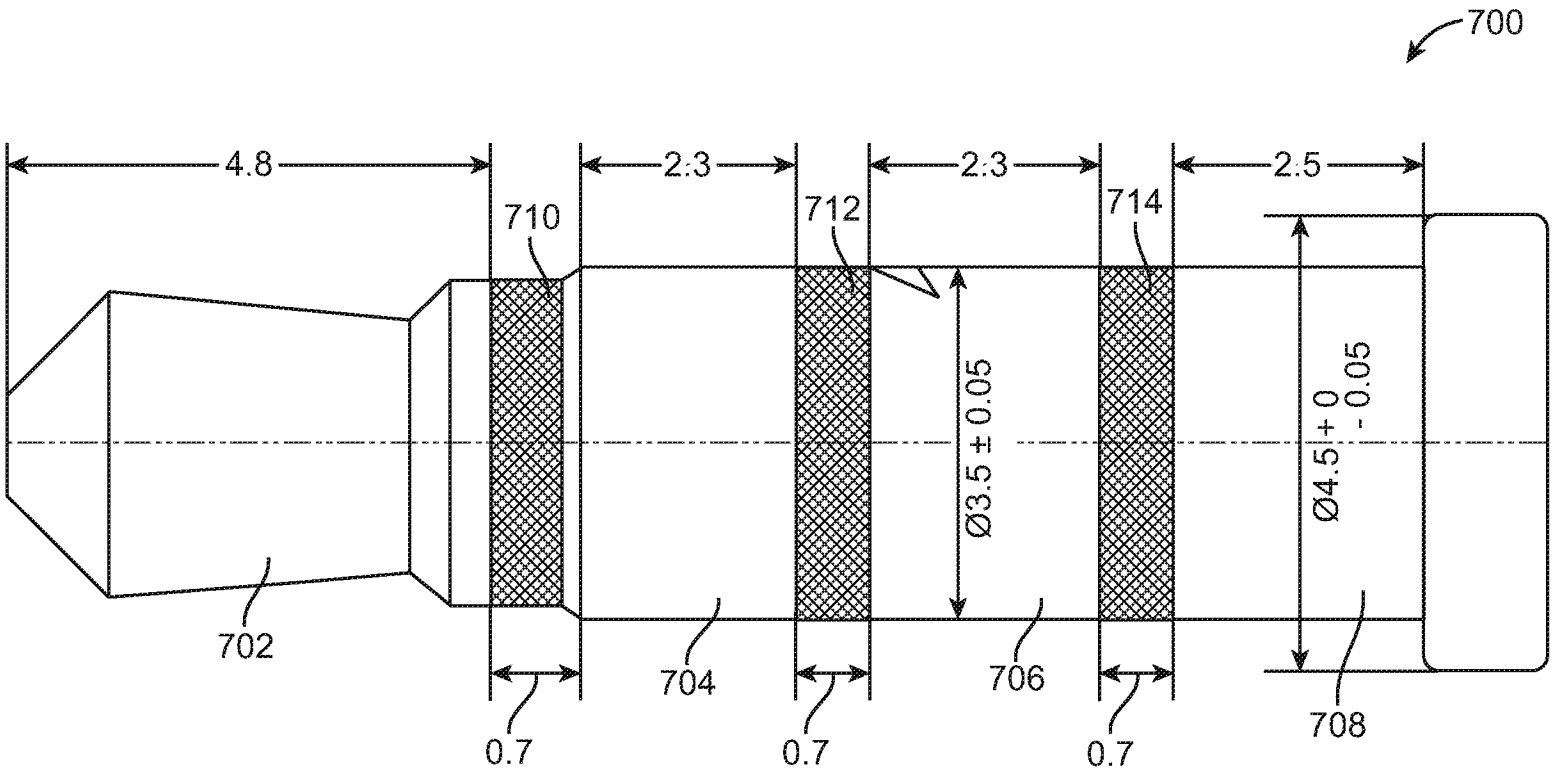
FIG. 7 (PRIOR ART)
FIG. 7 illustrates a prior art 3.5 mm male plug for coupling with a female jack.

FIG. 7 illustrates a prior art conventional 3.5 mm male plug 700 for coupling with the female jack 800 shown in FIG. 8. Referring to FIG. 7 and FIG. 8 together, the male plug 700 includes a tip contact segment 702 arranged to contact (i.e., electrically contact) the fourth contact terminal 808 of the female jack 800 when inserted. Tip contact segment 702 is approximately 4.8 mm.

A first ring contact segment 704 is arranged to contact the third contact terminal 806 of the female jack 800. First ring contact segment 704 is approximately 2.3 mm. Male plug 700 includes a first ring insulator segment 710 disposed between the tip contact segment 702 and the first ring contact segment 704. The first ring insulator segment 710 is approximately 0.7 mm.

A second ring contact segment 706 is arranged to contact the second contact terminal 804 of the female jack 800. The second ring contact segment 706 is approximately 2.3 mm. A second ring insulator segment 712 having length 0.7 mm is disposed between the first ring contact segment 704 and the second ring contact segment 706.

A sleeve contact segment 708 having length 2.5 mm is arranged to contact the first contact terminal 802 of the female jack 800. A third ring insulator segment 714 having length 0.7 mm is disposed between the second ring contact segment 706 and the sleeve contact segment 708.

In the prior art, male plug 700 is used in an audio application such as a telecommunications headset. For example, tip contact segment 702 is electrically connected to a left channel speaker circuit of a headset, the first ring contact segment 704 is electrically connected to a right channel speaker circuit of the headset, the second ring contact segment 706 is electrically connected to a ground circuit of the headset, and the sleeve contact segment 708 is electrically coupled to a microphone circuit of the headset.

The inventors have recognized a short-circuit will occur in prior art male plug 700 and female jack 800 should they be attempted to be utilized to deliver electrical current in a charging application where one of the female jack contact terminals is coupled to a VBUS voltage. For example, where first contact terminal 802 is coupled to VBUS and second contact terminal 804 is coupled to GROUND, the inventors have recognized that a short circuit will occur between the first contact terminal 802 and the second contact terminal 804 during the insertion or removal process of male plug 700. Specifically, the inventors have recognized first ring contact segment 704 having length 2.3 mm and second ring contact segment having length 2.3 mm, both having a length greater than first-to-second jack terminal separation distance d80 of 2.0 mm, will cause a short circuit as they simultaneously engage/contact first contact terminal 802 and second contact terminal 804 during insertion or removal.

In one example of the invention, a male plug is arranged to prevent short circuiting during the insertion and removal process with a female jack. The female jack includes a first contact terminal, a second contact terminal, a third contact terminal, and a fourth contact terminal. The first contact terminal and the second contact terminal are separated by a first-to-second jack terminal separation distance and the second contact terminal and the third contact terminal are separated by a second-to-third jack terminal separation distance. The male plug includes a tip contact segment arranged to contact the fourth contact terminal of the female jack. The male plug includes a first ring contact segment arranged to contact the third contact terminal of the female jack, where the first ring contact segment has a first ring contact segment length less than the first-to-second jack terminal separation distance and the second-to-third jack terminal separation distance. The male plug includes a first ring insulator segment disposed between the tip contact segment and the first ring contact segment.

The male plug further includes a second ring contact segment arranged to contact the second contact terminal of the female jack, where the second ring contact segment has a second ring contact segment length less than the first-to-second jack terminal separation distance and the second-to-third jack terminal separation distance. The male plug includes a second ring insulator segment disposed between the first ring contact segment and the second ring contact segment, and a sleeve contact segment arranged to contact the first contact terminal of the female jack. The male plug further includes a third ring insulator segment disposed between the second ring contact segment and the sleeve contact segment.

In a further example of the invention, a connector system includes a female jack and a male plug. The female jack includes a first contact terminal and a second contact terminal, where the first contact terminal and the second contact terminal are separated by a first-to-second jack terminal separation distance. The female jack includes a third contact terminal, where the second contact terminal and the third contact terminal are separated by a second-to-third jack terminal separation distance. The female jack further includes a fourth contact terminal. The male plug is removably insertable into the female jack. The male plug includes a tip contact segment arranged to contact the fourth contact terminal of the female jack when inserted. The male plug includes a first ring contact segment arranged to contact the third contact terminal of the female jack when inserted, where the first ring contact segment has a first ring contact segment length less than the first-to-second jack terminal separation distance and the second-to-third jack terminal separation distance. The male plug includes a first ring insulator segment disposed between the tip contact segment and the first ring contact segment.

The male plug further includes a second ring contact segment arranged to contact the second contact terminal of the female jack when inserted, where the second ring contact segment has a second ring contact segment length less than the first-to-second jack terminal separation distance and the second-to-third jack terminal separation distance. The male plug includes a second ring insulator segment disposed between the first ring contact segment and the second ring contact segment, and a sleeve contact segment arranged to contact the first contact terminal of the female jack when inserted. The male plug further includes a third ring insulator segment disposed between the second ring contact segment and the sleeve contact segment.

In a further example of the invention, a connector system includes a first connector system and a second connector system. The first connector system has a first connector system first end and a first connector system second end. The first connector system includes a female jack at the first connector system first end and a $1^{st}$ USB connector at the first connector system second end. The female jack includes a first contact terminal and a second contact terminal, wherein the first contact terminal and the second contact terminal are separated by a first-to-second jack terminal separation distance. The female jack includes a third contact terminal, wherein the second contact terminal and the third contact terminal are separated by a second-to-third jack terminal separation distance. The female jack further includes a fourth contact terminal.

The second connector system has a second connector system first end and a second connector system second end. The second connector system includes a male plug at the second connector system first end removably insertable into the female jack, and a $2^{nd}$ USB connector at the second connector system second end. The male plug includes: (a) a tip contact segment arranged to contact the fourth contact terminal of the female jack when inserted, (b) a first ring contact segment arranged to contact the third contact terminal of the female jack when inserted, wherein the first ring contact segment has a first ring contact segment length less than the first-to-second jack terminal separation distance and the second-to-third jack terminal separation distance, (c) a first ring insulator segment disposed between the tip contact segment and the first ring contact segment, (d) a second ring contact segment arranged to contact the second contact terminal of the female jack when inserted, wherein the second ring contact segment has a second ring contact segment length less than the first-to-second jack terminal separation distance and the second-to-third jack terminal separation distance, (e) a second ring insulator segment disposed between the first ring contact segment and the second ring contact segment, (f) a sleeve contact segment arranged to contact the first contact terminal of the female jack when inserted, and (g) a third ring insulator segment disposed between the second ring contact segment and the sleeve contact segment.

Figure 1:
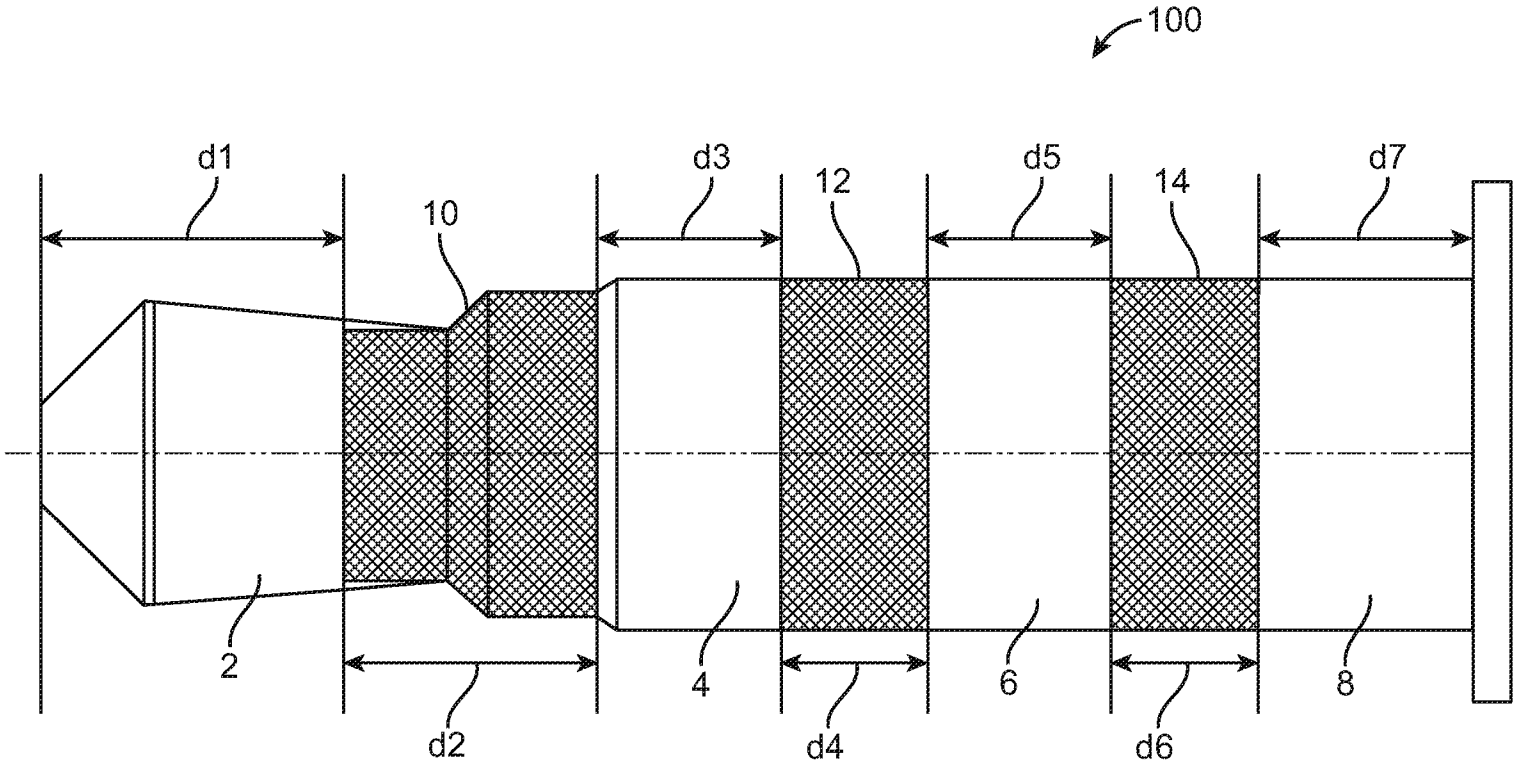
FIG. 1 illustrates a male plug for coupling with a female jack.
Figure 2:
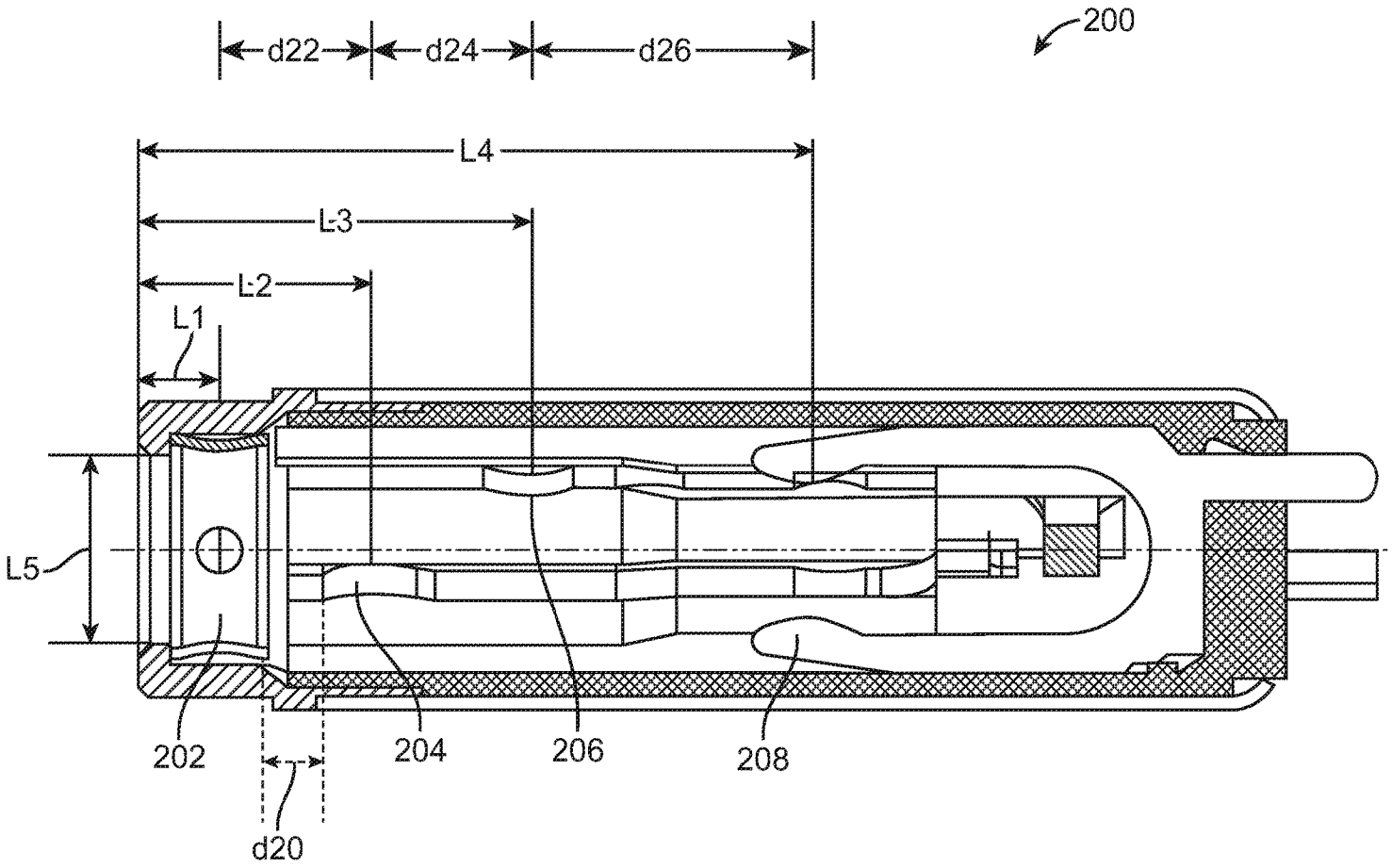
FIG. 2 illustrates a female jack for receiving the male plug shown in FIG. 1.

FIG. 1 illustrates a male plug 100 for coupling with a female jack 200, the female jack 200 shown in FIG. 2. Male plug 100 may be a 3.5 mm plug, where the outer diameter is 3.5 mm. Referring to FIG. 2, female jack 200 includes a first contact terminal 202, a second contact terminal 204, a third contact terminal 206, and a fourth contact terminal 208. The first contact terminal 202 and the second contact terminal 204 are separated by a first-to-second jack terminal separation distance d20. In this non-limiting example, first-to-second jack terminal separation distance d20 is measured as the gap between closest ends of the first contact terminal 202 and the second contact terminal 204. This is due to first contact terminal 202 having a width extending from its center point toward the second contact terminal 204. A distance d22 measures the distance between the center of first contact terminal 202 and second contact terminal 204 primary contact area.

The second contact terminal 204 and the third contact terminal 206 are separated by a second-to-third jack terminal separation distance d24. The third contact terminal 206 and the fourth contact terminal 208 are separated by a third-to-fourth jack terminal separation distance d26. Second-to-third jack terminal separation distance d24 and third-to-fourth jack terminal separation distance d26 are measured from the primary contact areas arranged to contact the corresponding male plug contacts. As also shown in FIG. 2, measured from the open end of female jack 200, first contact terminal 202 has a distance of L1, second contact terminal 204 has a distance of L2, third contact terminal 206 has a distance of L3, and fourth contact terminal 208 has a distance of L4. Female jack 200 has a width L5 at its open end to receive the male plug 100. In one example, L1=1.5 mm, L2=4.8 mm, L3=7.8 mm, L4=12.5 mm, and L5=3.5 mm.

Referring to FIG. 1 and FIG. 2 together, male plug 100 includes a tip contact segment 2 arranged to contact the fourth contact terminal 208 of the female jack 200 when inserted. Tip contact segment 2 has length d1. A first ring contact segment 4 is arranged to contact the third contact terminal 206 of the female jack 200. First ring contact segment 4 has length d3. Advantageously, first ring contact segment length d3 is arranged to be less than the first-to-second jack terminal separation distance d20 and the second-to-third jack terminal separation distance d24 to prevent short circuiting between first contact terminal 202 and second contact terminal 204 and prevent short circuiting between second contact terminal 204 and third contact terminal 206 when male plug 100 is inserted or removed.

Male plug 100 includes a first ring insulator segment 10 having length d2 disposed between the tip contact segment 2 and the first ring contact segment 4. A second ring contact segment 6 having length d5 is arranged to contact the second contact terminal 204 of the female jack 200. Advantageously, second ring contact segment length d5 is arranged to be less than the first-to-second jack terminal separation distance d20 and the second-to-third jack terminal separation distance d24 to prevent short circuiting between first contact terminal 202 and second contact terminal 204 and prevent short circuiting between second contact terminal 204 and third contact terminal 206 when male plug 100 is inserted or removed.

A second ring insulator segment 12 having length d4 is disposed between the first ring contact segment 4 and the second ring contact segment 6. A sleeve contact segment 8 having length d7 is arranged to contact the first contact terminal 202 of the female jack 200. A third ring insulator segment 14 having length d6 is disposed between the second ring contact segment 6 and the sleeve contact segment 8.

In one example embodiment, the first-to-second jack terminal separation distance d20 of female jack 200 is approximately 2 mm and the second-to-third jack terminal separation distance d24 is approximately 3 mm. In one example for this embodiment, the first ring contact segment length d3 of male plug 100 is 1.8 mm and the second ring contact segment length d5 is 1.8 mm. Advantageously, no short circuiting occurs because first ring contact segment length d3 (1.8 mm) is less than both first-to-second jack terminal separation distance d20 (2 mm) and second-to-third jack terminal separation distance d24 (3 mm), and second ring contact segment length d5 (1.8 mm) is less than both first-to-second jack terminal separation distance d20 and second-to-third jack terminal separation distance d24.

In one example, male plug 100 has a total length of 14.5 mm. The tip contact segment 2 has a tip contact segment length d1 of approximately 3.0 mm, the first ring contact segment length d3 is approximately 1.8 mm, the second ring contact segment length d5 is approximately 1.8 mm, and the sleeve contact segment 8 has a sleeve contact segment length d7 of approximately 2.5 mm. Tip contact segment 2 tapers slightly along its length, so it need not have a length less than first-to-second jack terminal separation distance d20 to avoid short circuiting the female jack 200 terminals.

Figures 3, 4:
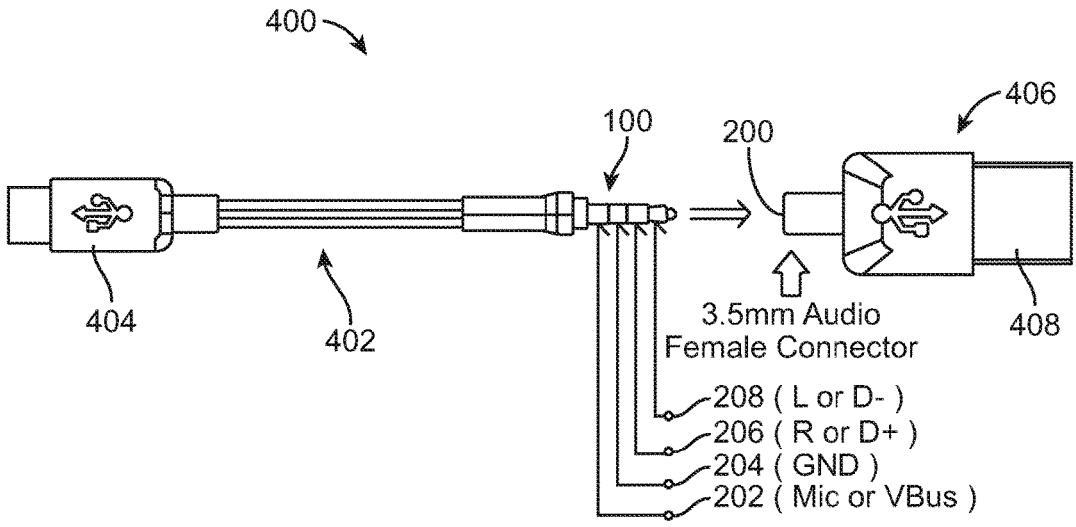
FIG. 3 is a table illustrating an example pin configuration of the male plug having both 3.5 mm audio and USB operability.
FIG. 4 is an example connector system utilizing the male plug and female jack in one example usage.

FIG. 3 is a table 300 illustrating an example pin configuration of male plug 100 having both 3.5 mm audio and USB operability. In USB operation, tip contact segment 2 is a D− contact, the first ring contact segment 4 is a D+ contact, the second ring contact segment 6 is a ground contact, and the sleeve contact segment 8 is a VBUS contact. In 3.5 mm audio operation, tip contact segment 2 is a left channel contact, the first ring contact segment 4 is a right channel contact, the second ring contact segment 6 is a ground contact, and the sleeve contact segment 8 is a microphone contact.

FIG. 4 is an example connector system 400 utilizing male plug 100 and female jack 200 in one example usage. Connector system 400 includes a cable 402 having a USB connector 404 at one end and male plug 100 at the other end. Connector system 400 also includes a connector device 406 having female jack 200 at one end and a USB connector 408 at the other end. The tip contact segment 2 of the male plug 100 is electrically connected to a D− pin of USB connector 404, the first ring contact segment 4 of the male plug 100 is electrically connected to a D+ pin of USB connector 404, the second ring contact segment 6 of the male plug 100 is electrically connected to a ground pin of USB connector 404, and the sleeve contact segment 8 of the male plug 100 is electrically coupled to a VBUS pin of USB connector 404.

The first contact terminal 202 of the female jack 200 is electrically connected to a VBUS pin of USB connector 408, the second contact terminal 204 of the female jack 200 is electrically connected to a ground pin of USB connector 408, the third contact terminal 206 of the female jack 200 is electrically connected to a D+ pin of USB connector 408, and the fourth contact terminal 208 of the female jack 200 is electrically connected to a D− pin of USB connector 408.

In a further example embodiment, USB connector 404 is replaced with a wireless headset having a rechargeable battery. Tip contact segment 2 of the male plug 100 is electrically connected to a left channel speaker circuit of the headset, the first ring contact segment 4 of the male plug 100 is electrically connected to a right channel speaker circuit of the headset, the second ring contact segment 6 of the male plug 100 is electrically connected to a ground circuit of the headset, and the sleeve contact segment 8 of the male plug 100 is electrically coupled to a microphone circuit of the headset.

Figure 5:
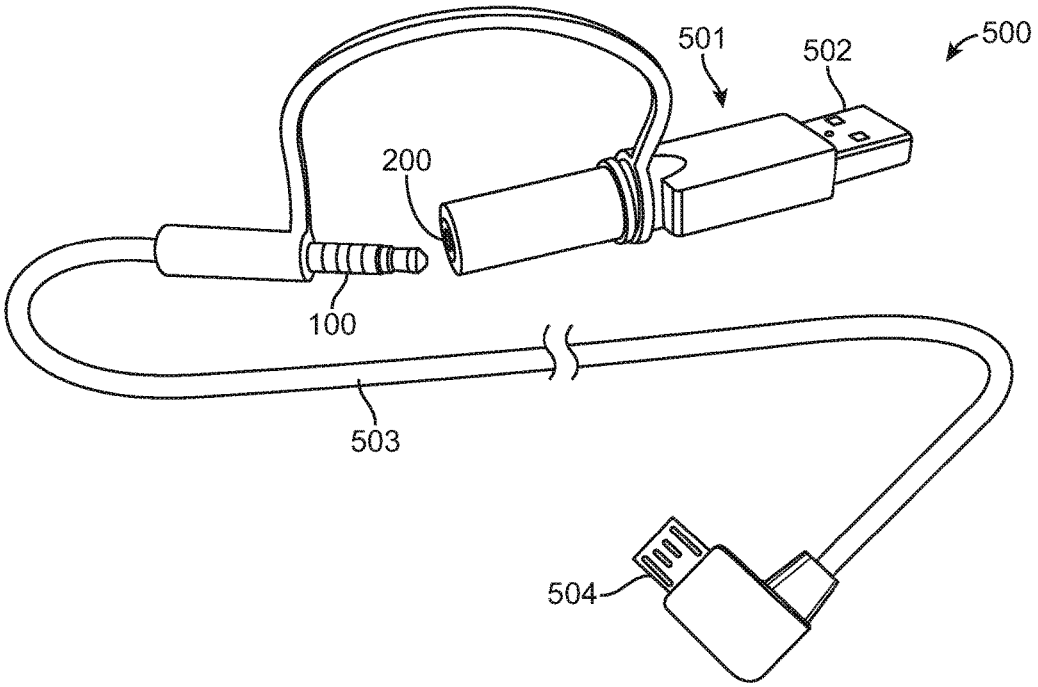
FIG. 5 illustrates a connector system utilizing the male plug and female jack in a coupled state.
Figure 6:
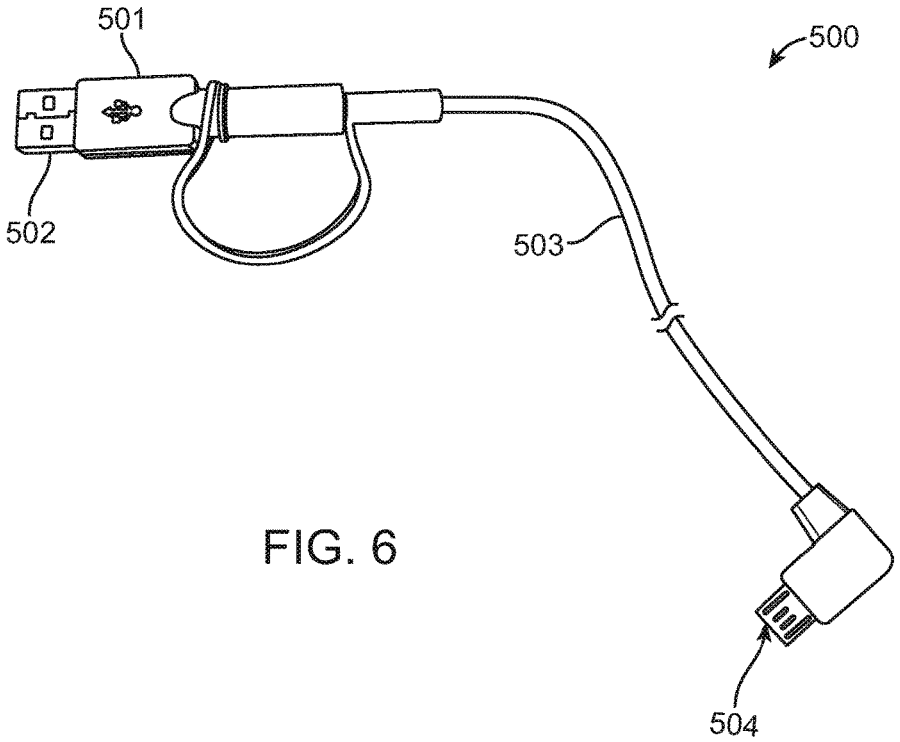
FIG. 6 illustrates the connector system shown in FIG. 5 where the male plug and female jack are in a decoupled state.

FIG. 5 and FIG. 6 are a connector system 500 utilizing male plug 100 and female jack 200 in a further example usage. The connector system 500 includes a connector device 501 having a female jack 200 at one end and a USB connector 502 at the other end. Connector system 500 includes a cable 503 having male plug 100 at one end and a micro-USB connector 504 at the other end. FIG. 5 illustrates male plug 100 and female jack 200 in a decoupled state. FIG. 6 illustrates male plug 100 and female jack 200 in a coupled state.

Tip contact segment 2 of the male plug 100 is electrically connected to a D-pin of the micro-USB connector 504, and the first ring contact segment 4 of the male plug 100 is electrically connected to a D+ pin of the micro-USB connector 504. The second ring contact segment 6 of the male plug 100 is electrically connected to a ground pin of the micro-USB connector 504, and the sleeve contact segment 8 of the male plug 100 is electrically coupled to a VBUS pin of the micro-USB connector 504.

The first contact terminal 202 of the female jack 200 is electrically connected to a VBUS pin of the USB connector 502, and the second contact terminal 204 of the female jack 200 is electrically connected to a ground pin of the USB connector 502. The third contact terminal 206 of the female jack 200 is electrically connected to a D+ pin of the USB connector 502, and the fourth contact terminal 208 of the female jack 200 is electrically connected to a D− pin of the USB connector 502.

In one usage scenario, connector system 500 is used with a wireless headset or other wireless audio device to provide either charging power to the wireless headset rechargeable battery or deliver audio signals to the wireless headset. The wireless headset has a connector interface to which a charging cable is coupled to provide charging power to the rechargeable battery. In the case of a wireless headset having limited space, a female micro-USB connector is typically used and placed somewhere on the headset. In one mode of operation, when connector system 500 is in a coupled state as shown in FIG. 6, micro-USB connector 504 is inserted into the female micro-USB connector at the headset. USB connector 502 is then inserted into a female USB connector coupled to a power source to provide charging power to the wireless headset rechargeable battery. Alternatively, in a second mode of operation, instead of delivering charging current, audio signals are delivered to the wireless headset via USB connector 502 for output at the headset speakers and/or microphone output signals from the wireless headset are transmitted to the device (e.g., a personal computer) coupled to USB connector 502, such as in a telecommunications application.

Providing additional flexibility and advantages, in a third mode of operation, male plug 100 may be decoupled from female jack 200 as shown in FIG. 5. Male plug 100 may be inserted into a headphone jack of an audio output device (e.g., a smartphone, tablet computer, personal computer, etc.) so that the wireless headset coupled to micro-USB connector 504 can be used in a corded mode even if the headset rechargeable battery is dead. Advantageously, if male plug 100 is removed from female jack 200 during charging, potential short circuiting is avoiding due to the inventive configuration of male plug 200 described herein.

While the exemplary embodiments of the present invention are described and illustrated herein, it will be appreciated that they are merely illustrative and that modifications can be made to these embodiments without departing from the spirit and scope of the invention. Acts described herein may be computer readable and executable instructions that can be implemented by one or more processors and stored on a computer readable memory or articles. The computer readable and executable instructions may include, for example, application programs, program modules, routines and subroutines, a thread of execution, and the like. In some instances, not all acts may be required to be implemented in a methodology described herein.

Terms such as "component", "module", "circuit", and "system" are intended to encompass software, hardware, or a combination of software and hardware. For example, a system or component may be a process, a process executing on a processor, or a processor. Furthermore, a functionality, component or system may be localized on a single device or distributed across several devices. The described subject matter may be implemented as an apparatus, a method, or article of manufacture using standard programming or engineering techniques to produce software, firmware, hardware, or any combination thereof to control one or more computing devices.

Thus, the scope of the invention is intended to be defined only in terms of the following claims as may be amended, with each claim being expressly incorporated into this Description of Specific Embodiments as an embodiment of the invention.

What is claimed is:

1. A connector cable for coupling with a female jack, the female jack comprising a first contact terminal, a second contact terminal, a third contact terminal, and a fourth contact terminal, wherein the first contact terminal and the second contact terminal are separated by a first-to-second jack terminal separation distance and the second contact terminal and the third contact terminal are separated by a second-to-third jack terminal separation distance, the connector cable comprising:

an audio male plug disposed at a first end of the connector cable for coupling with the female jack, the audio male plug comprising:

a tip contact segment arranged to contact the fourth contact terminal of the female jack;

a first ring contact segment arranged to contact the third contact terminal of the female jack, wherein the first ring contact segment has a first ring contact segment length less than the first-to-second jack terminal separation distance and the second-to-third jack terminal separation distance;

a first ring insulator segment disposed between the tip contact segment and the first ring contact segment;

a second ring contact segment arranged to contact the second contact terminal of the female jack, wherein the second ring contact segment has a second ring contact segment length less than the first-to-second jack terminal separation distance and the second-to-third jack terminal separation distance;

a second ring insulator segment disposed between the first ring contact segment and the second ring contact segment;

a sleeve contact segment arranged to contact the first contact terminal of the female jack; and a third ring insulator segment disposed between the second ring contact segment and the sleeve contact segment; and a USB connector disposed at a second end of the connector cable, the USB connector comprising:

a D− contact electrically connected to the tip contact segment of the audio male plug;

a D+ contact electrically connected to the first ring contact segment of the audio male plug;

a ground contact electrically connected to the second ring contact segment of the audio male plug; and a VBUS contact electrically connected to the sleeve contact segment of the audio male plug.

2. The connector cable of claim 1, wherein the first ring contact segment length of the audio male plug is less than 2.0 mm and the second ring contact segment length of the audio male plug is less than 2.0 mm.

3. The connector cable of claim 1, wherein the tip contact segment of the audio male plug has a tip contact segment length of approximately 3.0 mm, the first ring contact segment length is approximately 1.8 mm, the second ring contact segment length is approximately 1.8 mm, and the sleeve contact segment of the audio male plug has a sleeve contact segment length of approximately 2.5 mm, and wherein the audio male plug has a total length of 14.5 mm.

4. The connector cable of claim 1, wherein the USB connector is a micro-USB male connector.

5. The connector cable of claim 1, wherein the tip contact segment of the audio male plug is electrically connected to a left channel speaker circuit of an audio device, the first ring contact segment of the audio male plug is electrically connected to a right channel speaker circuit of the audio device, the second ring contact segment of the audio male plug is electrically connected to a ground circuit of the audio device, and the sleeve contact segment of the audio male plug is electrically coupled to a microphone circuit of the audio device.

6. The connector cable of claim 5, wherein the audio device comprises a headset having a microphone.

7. The connector cable of claim 1, wherein the first contact terminal of the female jack is electrically connected to a second VBUS contact of a second USB connector, the second contact terminal of the female jack is electrically connected to a second ground contact of the second USB connector, the third contact terminal of the female jack is electrically connected to a second D+ contact of the second USB connector, and the fourth contact terminal of the female jack is electrically connected to a second D− contact of the second USB connector.

8. The connector cable of claim 1, wherein the first-to-second jack terminal separation distance is approximately 2 mm and the second-to-third jack terminal separation distance is approximately 3 mm.

9. A connector system comprising:

a first connector system having a first connector system first end and a first connector system second end, the first connector system comprising:

a female jack at the first connector system first end, the female jack comprising:

a first contact terminal;

a second contact terminal, wherein the first contact terminal and the second contact terminal are separated by a first-to-second jack terminal separation distance;

a third contact terminal, wherein the second contact terminal and the third contact terminal are separated by a second-to-third jack terminal separation distance;

a fourth contact terminal; and a $1^{st}$ USB connector at the first connector system second end; and a second connector system having a second connector system first end and a second connector system second end, the second connector system comprising:

an audio male plug at the second connector system first end removably insertable into the female jack, the audio male plug comprising:

a tip contact segment arranged to contact the fourth contact terminal of the female jack when inserted;

a first ring contact segment arranged to contact the third contact terminal of the female jack when inserted, wherein the first ring contact segment has a first ring contact segment length less than the first-to-second jack terminal separation distance and the second-to-third jack terminal separation distance;

a first ring insulator segment disposed between the tip contact segment and the first ring contact segment;

a second ring contact segment arranged to contact the second contact terminal of the female jack when inserted, wherein the second ring contact segment has a second ring contact segment length less than the first-to-second jack terminal separation distance and the second-to-third jack terminal separation distance;

a second ring insulator segment disposed between the first ring contact segment and the second ring contact segment;

a sleeve contact segment arranged to contact the first contact terminal of the female jack when inserted; and a third ring insulator segment disposed between the second ring contact segment and the sleeve contact segment; and a $2^{nd}$ USB connector at the second connector system second end.

10. The connector system of claim 9, wherein the first ring contact segment length is less than 2.0 mm and the second ring contact segment length is less than 2.0 mm.

11. The connector system of claim 9, wherein the tip contact segment has a tip contact segment length of approximately 3.0 mm, the first ring contact segment length is approximately 1.8 mm, the second ring contact segment length is approximately 1.8 mm, and the sleeve contact segment as a sleeve contact segment length of approximately 2.5 mm, and wherein the audio male plug has a total length of 14.5 mm.

12. The connector system of claim 9, wherein the tip contact segment of the audio male plug is electrically connected to a D− contact of the $2^{nd}$ USB connector, the first ring contact segment of the audio male plug is electrically connected to a D+ contact of the $2^{nd}$ USB connector, the second ring contact segment of the audio male plug is electrically connected to a ground contact of the $2^{nd}$ USB connector, and the sleeve contact segment of the audio male plug is electrically coupled to a VBUS contact of the $2^{nd}$ USB connector.

13. The connector system of claim 12, wherein the $2^{nd}$ USB connector is a micro-USB male connector.

14. The connector system of claim 9, wherein the tip contact segment of the audio male plug is electrically connected to a left channel speaker circuit of a headset, the first ring contact segment of the audio male plug is electrically connected to a right channel speaker circuit of the headset, the second ring contact segment of the audio male plug is electrically connected to a ground circuit of the headset, and the sleeve contact segment of the audio male plug is electrically coupled to a microphone circuit of the headset.

15. The connector system of claim 9, wherein the first contact terminal of the female jack is electrically connected to a VBUS contact of the $1^{st}$ USB connector, the second contact terminal of the female jack is electrically connected to a ground contact of the $1^{st}$ USB connector, the third contact terminal of the female jack is electrically connected to a D+ contact of the $1^{st}$ USB connector, and the fourth contact terminal of the female jack is electrically connected to a D− contact of the $1^{st}$ USB connector.

16. The connector system of claim 9, wherein the first-to-second jack terminal separation distance is approximately 2 mm and the second-to-third jack terminal separation distance is approximately 3 mm.

* * * * *